US007168775B2

(12) United States Patent
Kuruma et al.

(10) Patent No.: US 7,168,775 B2
(45) Date of Patent: Jan. 30, 2007

(54) RECORDING APPARATUS

(75) Inventors: Kazuhisa Kuruma, Kanagawa (JP); Yasutaka Mitani, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 222 days.

(21) Appl. No.: 10/929,672

(22) Filed: Aug. 31, 2004

(65) Prior Publication Data

US 2005/0046652 A1 Mar. 3, 2005

(30) Foreign Application Priority Data

Sep. 3, 2003 (JP) ..... 2003-311446

(51) Int. Cl.
*B41J 29/38* (2006.01)

(52) U.S. Cl. ..... 347/14; 347/19

(58) Field of Classification Search ..... None
See application file for complete search history.

(56) References Cited

U.S. PATENT DOCUMENTS 6,241,334 B1 * 6/2001 Haselby ..... 347/19
6,527,359 B1 * 3/2003 Otsuki ..... 347/19

* cited by examiner

*Primary Examiner*—Thinh Nguyen
(74) *Attorney, Agent, or Firm*—Fitzpatrick, Cella, Harper & Scinto

(57) ABSTRACT

A recording apparatus includes a conveying unit for conveying a recording medium, a conveying motor for driving the conveying unit, an encoder for outputting a signal in accordance with the operating amount of the conveying unit, and a generating unit for generating an interruption signal when the conveying motor is stopped. The operating amount of the conveying unit is counted during a predesignated period beginning with the output of the interruption signal, and in accordance with the obtained count value, nozzles used for recording are selected and image recording is performed. With the above configuration, the recording apparatus removes problems, such as when a conveying unit conveys a recording medium, the halted position is shifted and the quality of an image formed on the recording medium is degraded, or when the conveying unit is operated to correct the position shifting, throughput is reduced.

10 Claims, 11 Drawing Sheets

| SHIFT DIRECTION | SHIFT AMOUNT | DATA SWAP | ARRAY | SELECTED NOZZLES | DRIVING ORDER |
|---|---|---|---|---|---|
| Yup | 4 | 0 | A | D0, D2, H0, H2 – H26 | 2→3→0→1 |
| | | | B | D1, D3, H1, H3 – H27 | |
| | 3 | 1 | A | D2, H0, H2 – H28 | 3→0→1→2 |
| | | | B | D1, D3, H1, H3 – H27 | 2→3→0→1 |
| | 2 | 0 | A | D2, H0, H2 – H28 | 3→0→1→2 |
| | | | B | D3, H1, H3 – H29 | |
| | 1 | 1 | A | H0, H2 – H30 | 0→1→2→3 |
| | | | B | D3, H1, H3 – H29 | 3→0→1→2 |
| Ydown | 1 | 1 | A | H2, H4 – H30, D4 | 1→2→3→0 |
| | | | B | H1, H3 – H31 | 0→1→2→3 |
| | 2 | 0 | A | H2, H4 – H30, D4 | 1→2→3→0 |
| | | | B | H3, H5 – H31, D5 | |
| | 3 | 1 | A | H4, H6 – H30, D4, D6 | 2→3→1→0 |
| | | | B | H3, H5 – H31, D5 | 1→2→3→0 |
| | 4 | 0 | A | H4, H6 – H30, D4, D6 | 2→3→0→1 |
| | | | B | H5, H7 – H31, D5, D6 | |

FIG. 6A

NOZZLE ARRAY A

| BLOCK No. | NOZZLE No. |
|---|---|
| 0 | H0, H8, H16, H24, D4 |
| 1 | H2, H10, H18, H26, D6 |
| 2 | D0, H4, H12, H20, H28 |
| 3 | D2, H6, H14, H22, H30 |

FIG. 6B

NOZZLE ARRAY B

| BLOCK No. | NOZZLE No. |
|---|---|
| 0 | H1, H9, H17, H25, D5 |
| 1 | H3, H11, H19, H27, D7 |
| 2 | D1, H5, H13, H21, H29 |
| 3 | D3, H7, H15, H23, H31 |

FIG. 6C

| BLOCK No. | BLK1 | BLK0 |
|---|---|---|
| 0 | 0 | 0 |
| 1 | 0 | 1 |
| 2 | 1 | 0 |
| 3 | 1 | 1 |

FIG. 8A

NOZZLE ARRAY A

| BLOCK No. | DDATA0 | HDATA0 | HDATA1 | HDATA2 | HDATA3 | DDATA1 |
|---|---|---|---|---|---|---|
| 0 | | H0 | H8 | H16 | H24 | D4 |
| 1 | | H2 | H10 | H18 | H26 | D6 |
| 2 | D0 | H4 | H12 | H20 | H28 | |
| 3 | D2 | H6 | H14 | H22 | H30 | |

FIG. 8B

NOZZLE ARRAY B

| BLOCK No. | DDATA0 | HDATA0 | HDATA1 | HDATA2 | HDATA3 | DDATA1 |
|---|---|---|---|---|---|---|
| 0 | | H1 | H9 | H17 | H25 | D5 |
| 1 | | H3 | H11 | H19 | H27 | D7 |
| 2 | D1 | H5 | H13 | H21 | H29 | |
| 3 | D3 | H7 | H15 | H23 | H31 | |

| SHIFT DIRECTION | SHIFT AMOUNT | DATA SWAP | ARRAY | SELECTED NOZZLES | DRIVING ORDER |
|---|---|---|---|---|---|
| Yup | 4 | 0 | A | D0, D2, H0, H2 – H26 | 2→3→0→1 |
| | | | B | D1, D3, H1, H3 – H27 | |
| | 3 | 1 | A | D2, H0, H2 – H28 | 3→0→1→2 |
| | | | B | D1, D3, H1, H3 – H27 | 2→3→0→1 |
| | 2 | 0 | A | D2, H0, H2 – H28 | 3→0→1→2 |
| | | | B | D3, H1, H3 – H29 | |
| | 1 | 1 | A | H0, H2 – H30 | 0→1→2→3 |
| | | | B | D3, H1, H3 – H29 | 3→0→1→2 |
| Ydown | 1 | 1 | A | H2, H4 – H30, D4 | 1→2→3→0 |
| | | | B | H1, H3 – H31 | 0→1→2→3 |
| | 2 | 0 | A | H2, H4 – H30, D4 | 1→2→3→0 |
| | | | B | H3, H5 – H31, D5 | |
| | 3 | 1 | A | H4, H6 – H30, D4, D6 | 2→3→1→0 |
| | | | B | H3, H5 – H31, D5 | 1→2→3→0 |
| | 4 | 0 | A | H4, H6 – H30, D4, D6 | 2→3→0→1 |
| | | | B | H5, H7 – H31, D5, D6 | |

RECORDING APPARATUS

BACKGROUND OF THE INVENTION

1. Field of the Invention

The present invention relates to a recording apparatus for using a recording head to record data on a recording medium.

2. Related Background Art

At present, as for printing apparatuses (recording apparatuses) which eject ink and print data on recording media, such as sheets or OHPs, apparatuses comprising a DC motor and a control encoder, for recording unit movement and recording medium feeding (conveying), have attained mainstream prominence, because they are capable of delicately controlling the ejection of ink.

As part of the printing processing performed by a conventional recording apparatus, first, a recording medium feeding motor (a line feed motor) is activated to convey a recording medium to the front of a recording unit, where it is halted. Then, the ejection of ink is conducted for printing, while a recording unit movement motor (a carriage driving motor) is activated to move the recording unit to the right or left, after which it is halted. Then, the recording medium feeding motor is again activated to convey the recording medium and it is halted. This processing sequence is repetitively performed until the printing process is terminated.

The following is an example of a method for halting a DC motor. A roller has rotated until a recording medium reaches a target position, whereupon the DC motor is powered off and is halted by its inertia. However, the location whereat the motor is actually halted tends to shift because of various factors, for example, cogging of the DC motor or vibration caused by another operation (such as the movement of a carriage).

As is described above, ideally, a recording medium is halted during the operation of a recording unit; in actuality, however, following the feeding process, inertia, mechanical vibration or the like may cause the recording medium to move even during printing, (slippage occurs) thereby deteriorating a printed image. According to a conventional control method for preventing recording medium slippage during the operation of the recording unit, the printing speed is merely reduced, or the recording operation is temporarily halted to return the recording medium to the correct halted position.

Fast printing is required of current mainstream printers, and a reduction in printing speed, or the temporary halting of a printing operation, to correct for slippage, leads to a disadvantage for a product.

It is, therefore, one objective of the present invention to provide a technique whereby, even when the location of a recording medium is shifted during printing, a reduction in recording speed (throughput) or the degradation of image quality can be prevented, and high-quality printing (recording) can be preformed.

SUMMARY OF THE INVENTION

To resolve the conventional shortcoming and to achieve the objective, according to one aspect of the invention, a recording apparatus for recording data on a recording medium using a recording head provided with a plurality of orifices, comprises:

conveying means for conveying the recording medium;

a motor for driving the conveying means;

signal generation means for outputting a signal in accordance with an operation of the conveying means;

interruption output means for receiving the signal and outputting an interruption signal when the conveying means realizes the arrival at a predetermined position;

counting means for counting, after the interruption signal has been output, an operating amount of the conveying means by using the signal output by the signal generation means;

nozzle selection means for selecting a nozzle to be used for recording, from among the plurality of nozzles, in accordance with a count value of the counting means; and recording means for performing recording using the nozzle selected by the nozzle selection means.

According to another aspect of the present invention, a recording apparatus for recording data on a recording medium using a recording head provided with a plurality of orifices, comprises:

conveying means for conveying the recording medium;

a motor for driving the conveying means;

signal generation means for outputting a signal in accordance with an operation of the motor;

interruption output means for receiving the signal and outputting an interruption signal when the motor realizes the arrival at a predetermined position;

counting means for counting, after the interruption signal has been output, an operating amount of the motor by using the signal output by the signal generating means;

nozzle selection means for selecting a nozzle to be used for recording, from among the plurality of nozzles, in accordance with a count value of the counting means; and recording means for performing recording using the nozzle selected by the nozzle selection means.

According to an additional aspect of the present invention, a recording apparatus for recording data on a recording medium using a recording head provided with a plurality of nozzle arrays, comprises:

conveying means for conveying the recording medium;

designation means for designating a predetermined halted location for the conveying means;

acquisition means for obtaining the amount of slippage between the predetermined halted position, designated by the designation means, and a halted position to which the recording medium is actually conveyed by the conveying means;

nozzle selection means for selecting, for each of the nozzle arrays, a nozzle to be used for recording;

data generation means for generating recording data for each of the nozzle arrays;

allocation means for allocating, to the nozzle selected by the nozzle selecting means, the recording data generated by the data generating means; and control means for controlling the nozzle selection means and the allocation means based on the amount of slippage obtained by the acquisition means.

According to a further aspect of the present invention, a recording apparatus for recording data on a recording medium using a recording head provided with a plurality of nozzle arrays, comprises:

conveying means for conveying the recording medium;

designation means for designating a predetermined halted position for the conveying means;

acquisition means for obtaining a differential amount between the desired halted position, designated by the designation means, and a position at which the recording medium, conveyed by the conveying means, is actually halted;

nozzle selection means for selecting, for each of the nozzle arrays, a nozzle used for recording;

data generation means for generating recording data for each of the nozzle arrays;

driving means, for driving each of the nozzle arrays;

transfer selection means for changing, for the driving means, a destination for the transfer of the recording data generated by the data generation means; and control means for controlling the nozzle selection means and the transfer selection means based on the differential amount obtained by the acquisition means.

According to these configurations, even when the halted position of the conveying means is shifted, recording using a recording head is performed according to an amount of the shift, so that high-quality image recording can be performed without recording throughput being reduced.

BRIEF DESCRIPTION OF THE DRAWINGS

FIGS. 6A, 6B and 6C are diagrams for explaining blocks of nozzles to be driven by the recording head shown in FIG. 5;

FIGS. 8A and 8B are diagrams for explaining a relationship between the transfer of data to the recording head and the nozzle blocks;

DETAILED DESCRIPTION OF THE PREFERRED EMBODIMENTS

The preferred embodiments of the present invention will now be described in detail while referring to the accompanying drawings.

(First Embodiment)

Figure 1:
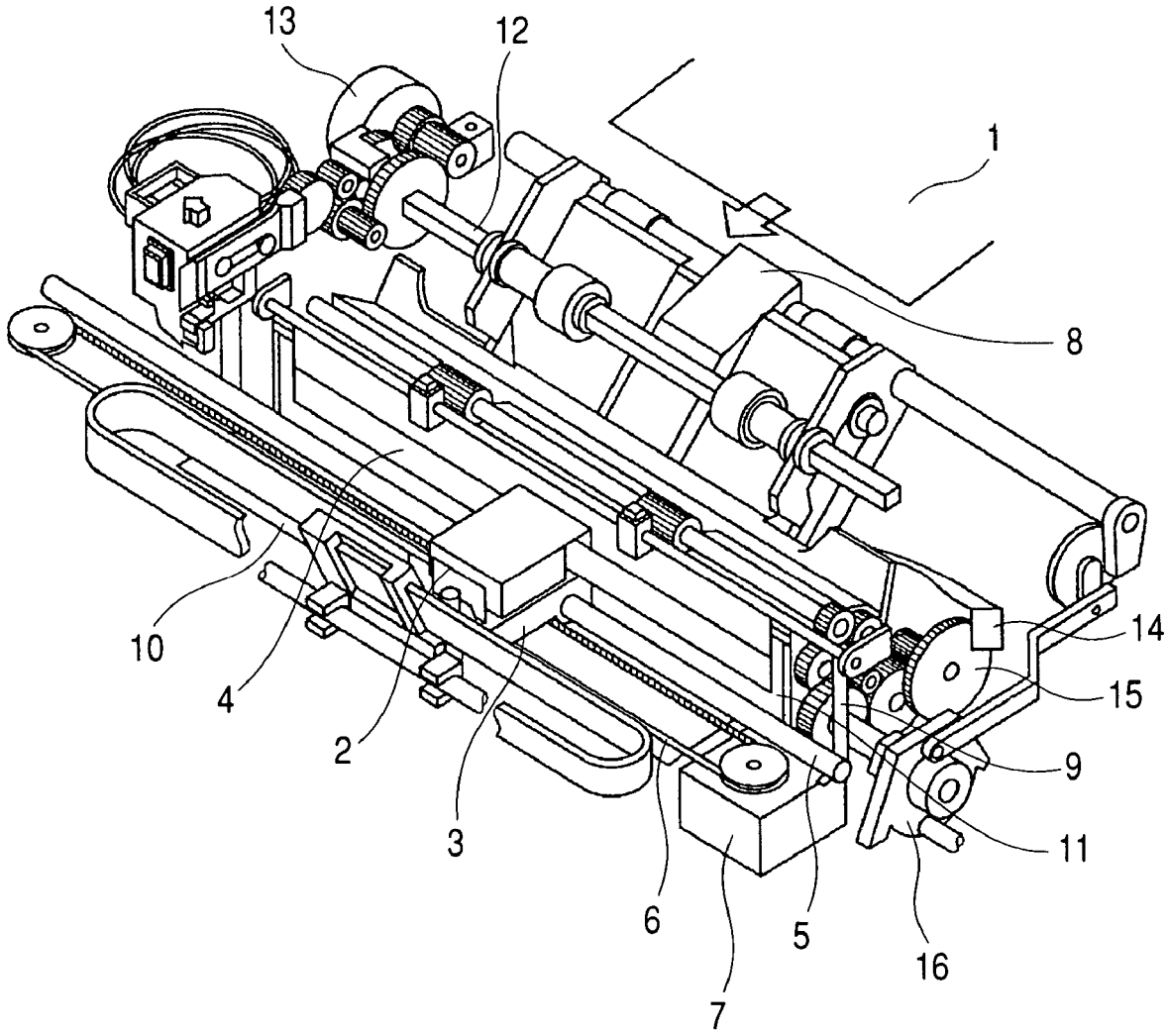
FIG. 1 is a perspective view of a printer according to one embodiment of the present invention.

An explanation will be given for the control processing performed by an ink jet printer (a recording apparatus) when a recording medium is shifted during printing. First, the control processing will be explained for a situation in which no shifting of a recording medium (e.g. a recording sheet) occurs during printing. In FIG. 1, an ink jet printer comprises: a recording unit (carriage) 2; and a head (a recording head) 3, positioned beneath the carriage 2, for performing the printing of a recording medium 1 through the ejection of tiny ink droplets.

The carriage 2 is relatively moved in a direction differing from the direction in which the recording medium 1 is fed, and when the recording medium 1 is positioned at the head 3, tiny ink droplets are accurately ejected onto printing positions to record a high-quality image. The carriage 2 is guided by a shaft 5, shaped like a bar, and is moved and controlled by a drive belt 6 and a carriage drive motor 7. The carriage 2 incorporates an encoder sensor, which outputs a signal for a slit in a carriage encoder film 4 and counts the signal in a gate array, and thereby controls the positioning of the carriage 2. When the shaft 5 is rotated by a drive motor 13, a lift member 9 for the shaft 5 is moved upward and downward to change the heights of the carriage 2 and the head 3.

A platen 10, for supporting the recording medium 1, is located beneath the head 3, and a device (an automatic sheet feeder) 8 automatically feeds the recording medium 1. The recording medium 1 set in the automatic sheet feeder 8 is conveyed (supplied) inside the recording apparatus by rollers 12 provided for the automatic sheet feeder 8, which is driven by the drive motor 7. The thus supplied recording medium 1 is fed by a line feed motor 16 to the platen 10, which supports the recording medium 1, and when the recording medium 1 reaches the printing position for the head 3, the line feed motor 16 is halted. Thereafter, the recording operation is initiated. That is, the carriage driving motor 7 is rotated to move the carriage 2 horizontally and ink is ejected.

When the carriage driving motor 7 has been halted, the line feed motor 16 begins to rotate and conveys the recording medium 1 an appropriate distance. After the conveying operation has been completed, the carriage driving motor 7 is again rotated to eject ink.

For the line feed operation (the conveying operation), as well as the operation for driving the carriage 2, the encoder 14 is employed to control the conveying position and the conveying speed. The reference numeral 15 denotes an encoder film 15 for line feeding.

As is described above, an image is recorded on the recording medium 1 by alternately performing the main scanning that moves the carriage 2 and the sub-scanning during which the recording medium 1 is conveyed. When no more data is to be recorded, the recording operation is terminated and the recording medium 1 is discharged.

Instead of the thus explained processing, and in order to improve the throughput for the recording operation, the carriage driving motor 7 may be started immediately before the conveying operation is terminated (when the line feed motor 16 is halted). For example, the acceleration of the carriage driving motor 7 may be started at the timing for the deceleration of the line feed motor (the conveying motor) 16.

Figure 2:
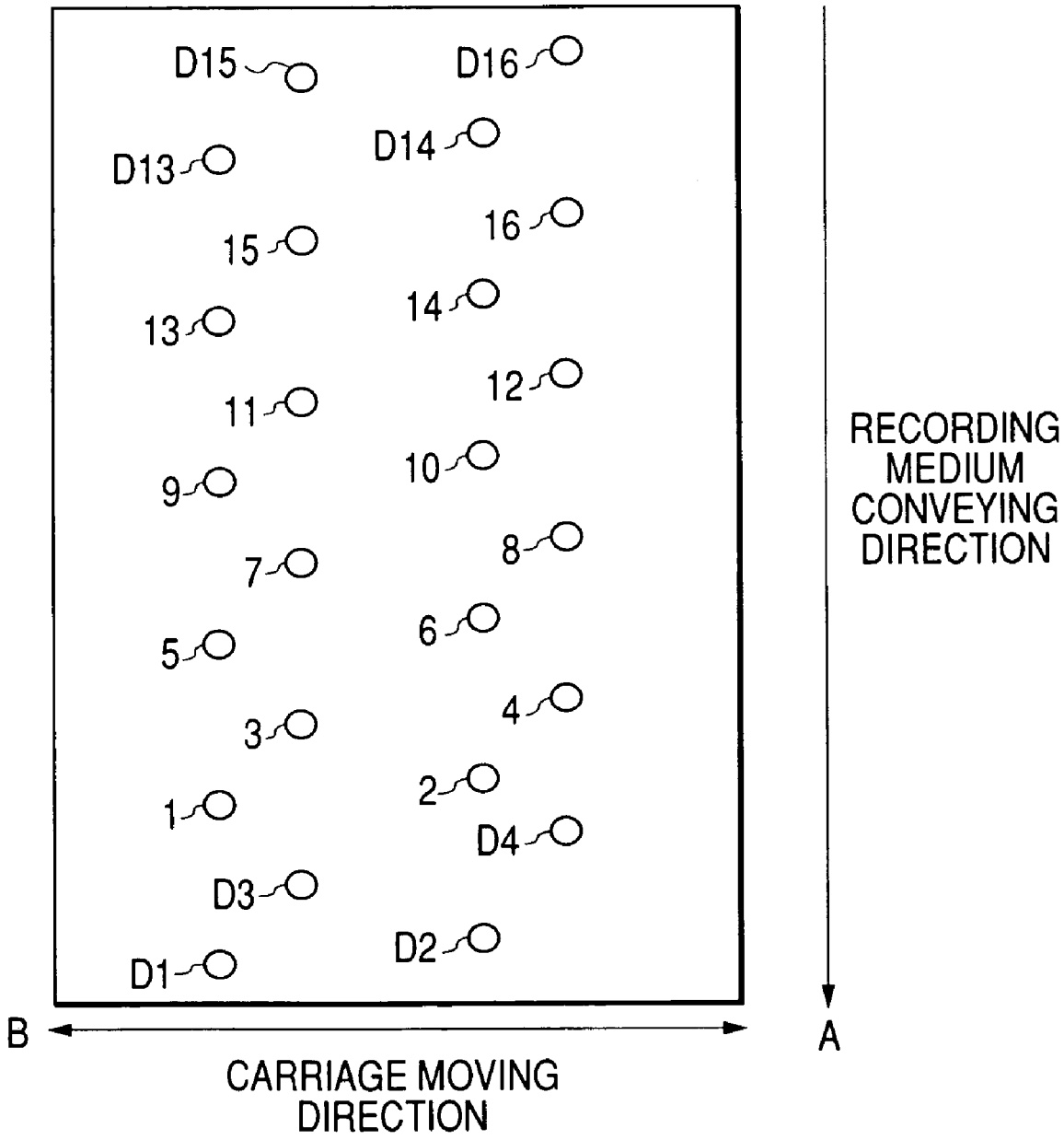
FIG. 2 is a diagram for explaining the nozzle arrangement of a recording unit (recording head) according to the embodiment.

An explanation will now be given for the control processing performed when a position of the recording medium 1 is shifted at the end of the conveying operation for printing (for recording). In FIG. 2, the nozzle arrangement of the head 3 is shown. Nozzles are arranged in the direction in which the recording medium 1 is conveyed, and as is shown in FIG. 2, the head 3 has two nozzle arrays.

Numbers in the nozzle arrangement are nozzle numbers 1 to 16, used to denote nozzles from which ink is ejected to record an image when no slippage of the recording medium 1 has occurred during printing. Nozzles denoted by D are used for ejecting ink to record an image, when slippage of the recording medium 1 has occurred.

During printing, while the carriage 2 is being moved in a direction B shown in FIG. 2, ink is ejected from the nozzles (orifices) of arrays [1, 5, 9 and 13], and then from the nozzles of arrays [2, 6, 10 and 14].

Thereafter, the recording medium 1 is conveyed in the direction B. Then, while the carriage 2 is being moved in the direction B, ink is ejected from the nozzles of arrays [4, 8, 12 and 16], and from the nozzles of arrays [3, 7, 11 and 15].

The above described operation, wherein the carriage 2 is moved in the direction B, recording is performed by the two nozzle arrays, and then the recording medium 1 is conveyed, is repeated.

Figure 3:
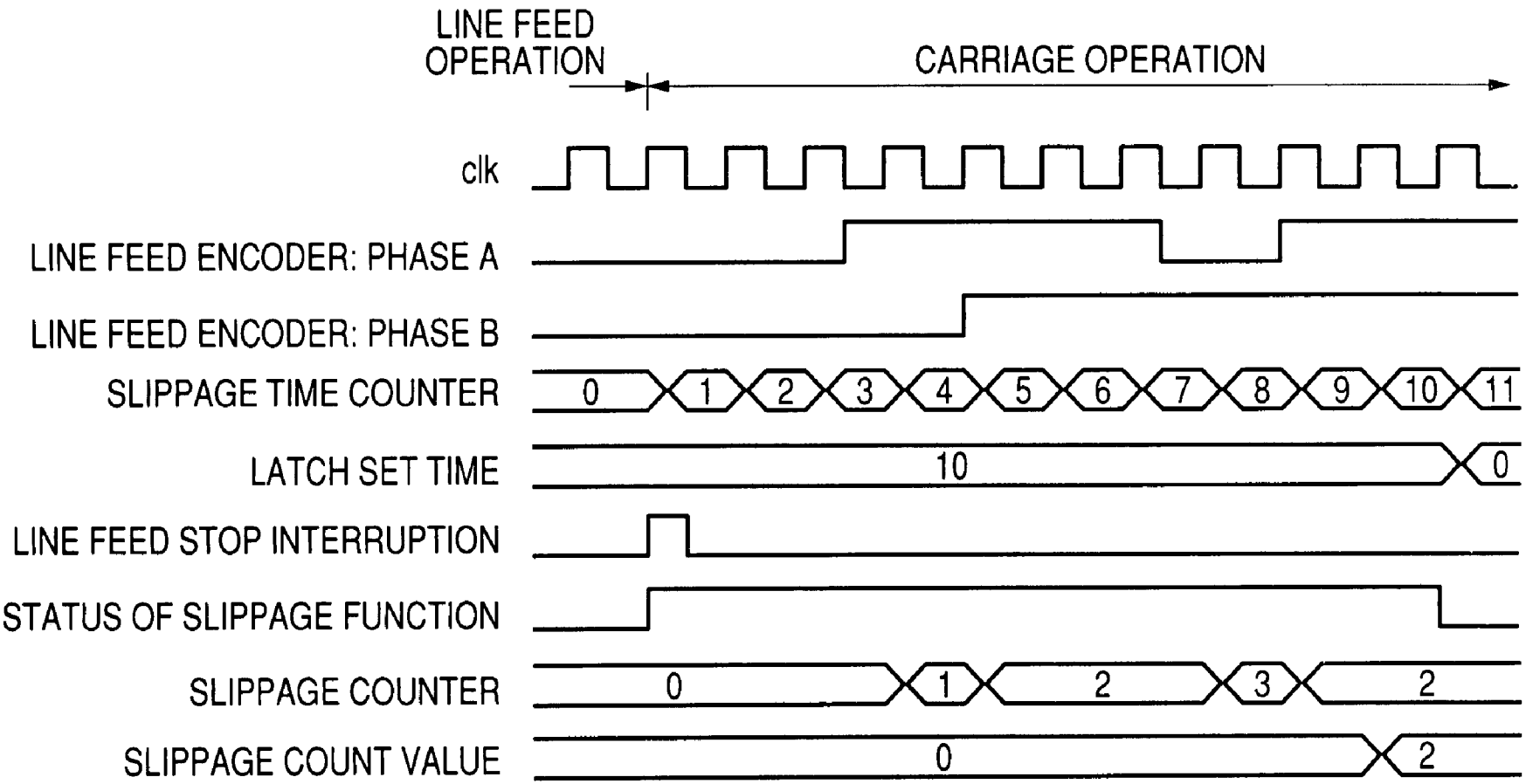
FIG. 3 is a diagram for explaining a timing for a gate array signal according to the embodiment.

FIG. 3 is a diagram for explaining the individual signals for a gate array when a state wherein the line feed motor 16 has reached the halted position, shifts to a state where the movement of the carriage 2 starts.

In FIG. 3, clk denotes a main clock signal for a gate array; phases A and B for a line feed encoder correspond to output waveforms for the line feed encoder; a value held by a slippage time counter corresponds to, for example, the distance a recording medium has moved until the conveying means (the conveying roller) is actually halted after an output of a signal for moving the line feed motor has been suspended. In FIG. 3, the signals for the line feed encoder phases A and B are slightly altered. This means that immediately after the halt signal is output, the conveying means moves slightly before it is halted completely. Further, the resolution obtained during phase A or B corresponds to the resolution for one nozzle.

When, based on a signal from the encoder, a conveying control means determines that the recording medium has reached a target position, the conveying control means generates a line feed stop interruption. Whether the target position has been reached is established, by, for example, counting the signal pulses output by the encoder.

When the generation of the line feed stop interruption is detected, counting performed by a slippage counter is begun. That is, a latch setup time is provided in advance for a latch setup register, and the counting process continues until the latch setup time has elapsed. When the latch setup time has elapsed, a value held by the slippage counter is latched and stored as a slippage count value.

This slippage count value is employed to select a nozzle to be used for the carriage scanning that is performed following the line feed operation. When the nozzle has been selected, the recording head 3 is started, and ink is ejected from the selected nozzle in the recording head 3.

The latch time is a value for a period required to completely halt the activating conveying means, which is obtained through experimentation, and prior discussions and simulations.

A slippage count value "1" corresponds to the distance between each two nozzle numbers in FIG. 2 in the direction in which the recording medium 1 is moved, e.g., the distance between nozzle 1 and nozzle 2 in the feeding direction. A slippage function status is a status signal indicating that slippage counting is currently being performed.

Referring to FIG. 3, since the value of the latch time is set as "10", a value of "2", held by the slippage counter, is stored as a slippage count value when the slippage time counter value reaches ten. In this case, the slippage count value "2" means that the recording medium has been shifted a distance equivalent to two nozzles in the conveying direction.

During the printing processing, the carriage 2 is moved in the direction B, and when ink is ejected through the nozzles of arrays [1, 5, 9 and 13], the dots that are formed are shifted away from the normal positions. To correct this shifting, however, time is required to drive a motor to return the recording medium at the shift distance.

Therefore, in the above case, while the nozzles in arrays [1, 5, 9 and 13] are not employed first, ink is ejected from nozzle arrays [D3, 3, 7 and 11], and then nozzle arrays [D4, 4, 8 and 12]. Since the ink ejection nozzles are changed in this manner in accordance with the slippage count value (the breadth of the nozzle range to be employed is changed), an image can be printed without an additional expenditure of time and without non-aligned dots being printed.

Figure 4:
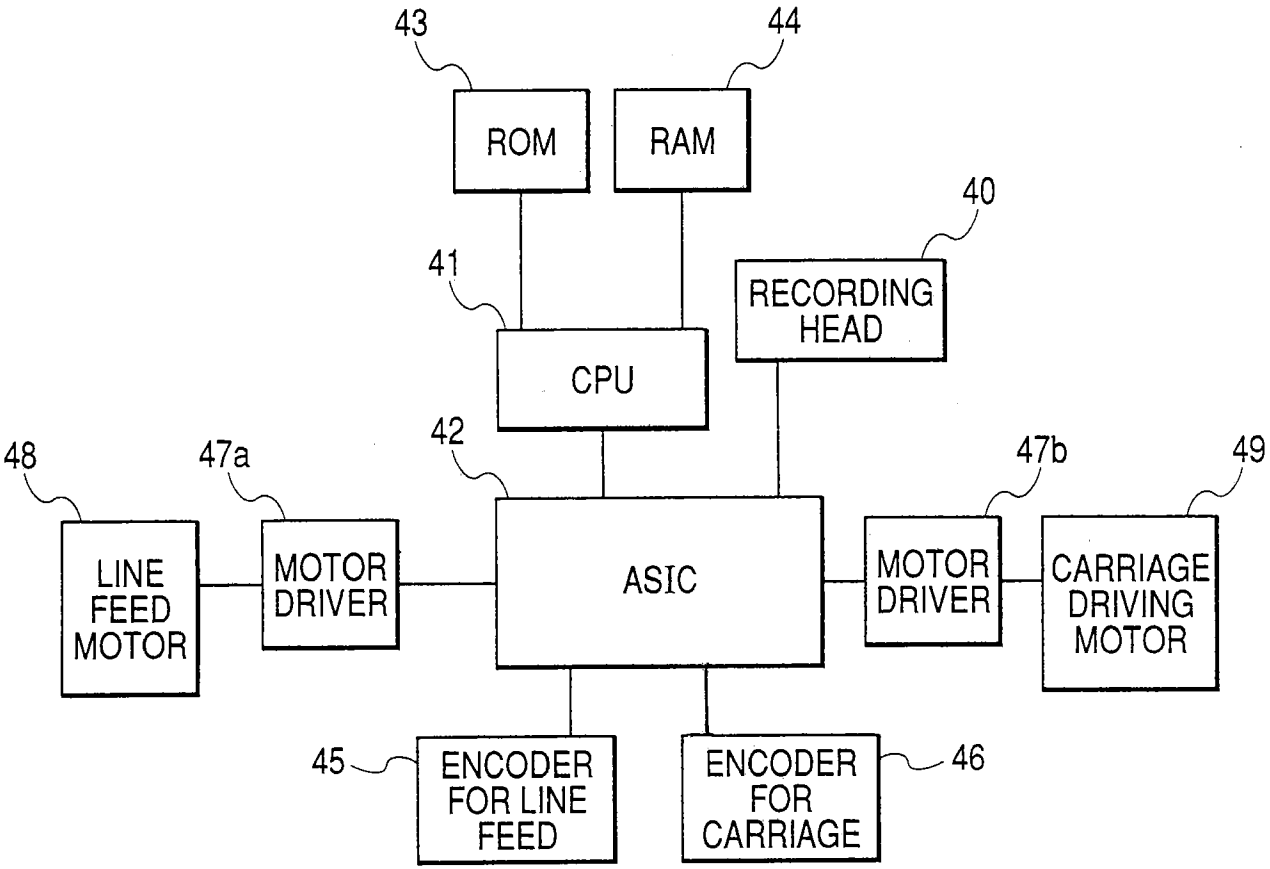
FIG. 4 is a control block diagram for the printer according to the embodiment.

FIG. 4 is a control block diagram showing the recording apparatus. The recording apparatus comprises: a recording head 40, a CPU 41, a gate array (ASIC) 42, a ROM 43, a RAM 44, an encoder 45 for line feeding, an encoder 46 for a carriage, motor drivers 47*a* and 47*b*, a line feed motor 48 and a carriage driving motor 49.

Based on a control program stored in the ROM 43, the CPU 41 accesses the gate array 42 and controls the recording apparatus.

The gate array 42 includes the above described slippage counter, a latch for latching the value held by the slippage counter, and a register for setting a latch time. The gate array 42 also includes a selector for selecting a nozzle used for ink ejection, while the slippage count value is set for the selector.

As is described above, when the conveying operation (line feed operation) has been completed, the slippage count value (slippage information) is obtained and is set for the selector when recording for each scan is started.

As above-mentioned, when the conveying operation has been completed, a nozzle in the recording head is selected in accordance with the amount of shift in the conveying direction. Further detailed description will be given as hereinbelow.

Figure 5:
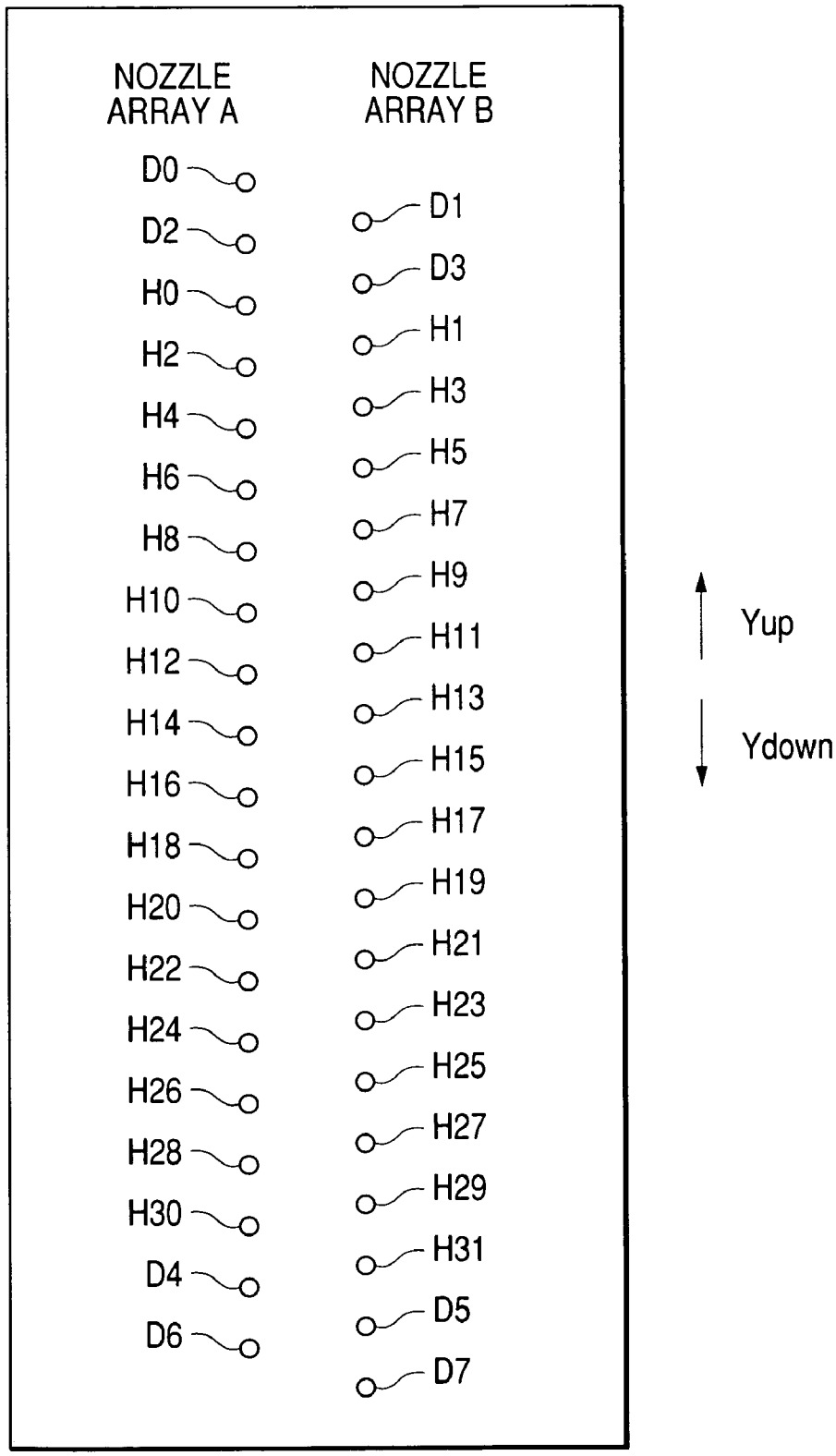
FIG. 5 is a diagram for explaining the nozzle arrangement for the recording unit (recording head) according to the embodiment.

The nozzle arrangement for the recording head is shown in FIG. 5. The recording head includes a nozzle array A and a nozzle array B, in each of which are twenty nozzles. Yup denotes the direction in which the recording medium is conveyed from upstream to downstream, and Ydown denotes the opposite direction.

As for the nozzle arrays, A, D0, D2, D4 and D6 are correction (adjustment) nozzles when slippage of the recording medium occurs while the conveying means is halted. Therefore, these nozzles are not employed so long as no slippage has occurred.

H0, H1, and H6 to H30 are nozzles used for recording. These nozzles are provided at the same pitches of 600 dpi. Similarly, as for the nozzle arrays, B, D1, D3, D5 and D7 are nozzles used for correction (printing adjustment).

The interval between the nozzle H0 and the nozzle H1 in the direction Yup, and the interval between the nozzle H1 and the nozzle H2 in the Yup direction are 1200 dpi. That is, the nozzles of the nozzle array A and the nozzles of the nozzle array B are arranged at intervals of 1200 dpi.

The number of nozzles is not limited to twenty, and the resolution is also not limited to 1200 dpi. In addition, the number of nozzle arrays is not limited to two.

FIGS. 6A, 6B and 6C are diagrams for explaining the driving of the nozzles in the recording head in FIG. 5. Referring to FIG. 6A, groups of nozzles in a nozzle array to be driven are shown, and twenty nozzles, which form one array, are divided into four groups, for which numbers 0 to 3 are provided. The table shown in FIG. 6A is for the nozzle array A, and the table shown in FIG. 6B is for the nozzle array B.

In FIG. 6A, the group for block number 0 includes five nozzles, H0, H8, H16, H24 and D4, and the group for block number 1 includes five nozzles, H2, H10, H18, H26 and D6. The group for block number 2 includes five nozzles, D0, H4, H12, H20 and H28, and the group for block number 3 includes five nozzles, D2, H6, H14, H22 and H30.

When block number 0, for example, is designated to be driven, the five nozzles H0, H8, H16, H24 and D4 are driven. And when block number 1 is designated, the five nozzles D0, H4, H12, H20 and H28 are driven. As is described above, for the nozzle array A, the nozzles of a block designated at a specific drive time are designated at the same time.

This is applied also for the nozzle array B. As is shown in FIG. 6B, the nozzles of the nozzle array B are divided into four groups at four nozzle intervals. It should here be noted that the number of blocks is not limited to four.

Figure 7A:
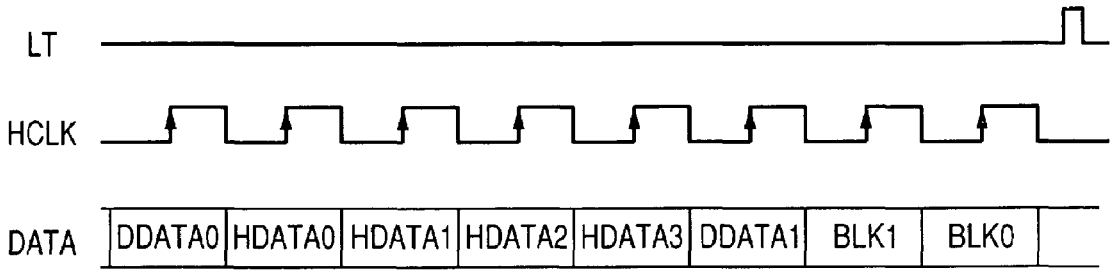
FIGS. 7A and 7B are diagrams for explaining the transfer of data to the recording head.
Figure 7B:
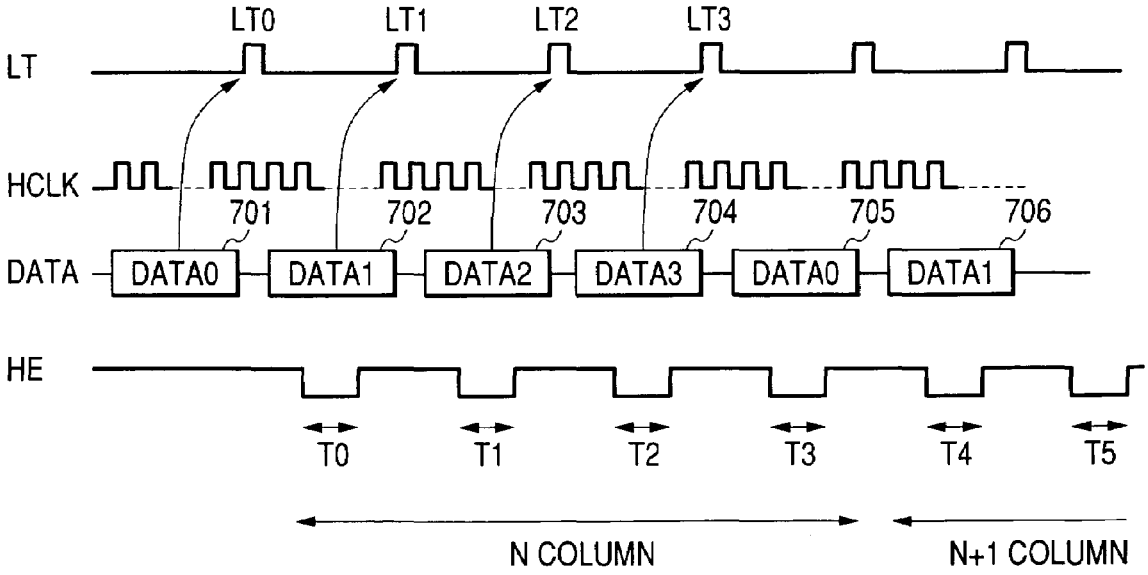

FIGS. 7A and 7B are diagrams for explaining a drive timing and drive data. In FIG. 7A, the transfer of data for one block is performed in synchronization with a clock signal HCLK. This data includes eight bits, of which two are data bits (DDATA0 and DDATA1) corresponding to a correction nozzle, four are data bits (HDATA0 to HDATA3) corresponding to a generally employed nozzle, and two are data bits (BLK0 and BLK1) for designating a block number. These data are latched in accordance with a latch signal LT, and are driven in accordance with a heat enable signal HE that is generated afterwards. It should be noted that, as is shown in FIG. 6C, four blocks can be designated in accordance with BLK1 and BLK0.

In FIG. 7B, the transfer of data for one nozzle array (data for the Nth column) is shown. As is described above, for transfer, the data are divided into four groups. The data transfer for all the blocks is performed in the order block 0, block 1, block 2 and block 3. Data 701 is for block number 0, data 702 is for block number 1, data 703 is for block number 2 and data 704 is block number 3. When the data 701 to 704 are transmitted, the data transfer for one column to be recorded in the N-th column of the recording medium is performed.

Furthermore, data 705 is to be recorded at the position for the N+1-th column and has a block number of 0, and data 706 is also to be recorded at the position for the N+1-th column and has a block number of 1.

An explanation will now be given for the latching process using the data latch signal LT, and the drive timing using the heat enable signal HE.

The data 701 is latched in accordance with a latch signal LT0, and is transmitted at time T0 for the heat signal HE. In accordance with the transmitted data, ink ejection is performed. Similarly, the data 702 is latched in accordance with a latch signal LT1, and is transmitted at time T1 for the heat enable signal HE. The data 703 is latched in accordance with a latch signal LT2, and is transmitted at time T2 for the heat enable signal HE. And the data 704 is latched in accordance with a latch signal LT3, and is transmitted at time T3 for the heat enable signal HE. Through this processing, from time T0 to time T3, recording for one column can be performed by using a single nozzle array.

The above described transfer order, block 0, block 1, block 2 and block 3, is employed when shifting of the halted position does not occur, and is changed depending on an amount of the shift of the halted position, which will be described later.

When bidirectional recording is performed by scanning using the recording head, the transfer order in one scanning direction is block 0, block 1, block 2 and block 3, while the transfer order in the other scanning direction is block 3, block 2, block 1 and block 0.

FIGS. 8A and 8B are diagrams for explaining the relationship between data to be transmitted and nozzles. When data for block 0 of the nozzle array B is to be transmitted, while referring to FIG. 8B, DDATA0 is unused, HDATA0 is data for nozzle H1, HDATA1 is data for nozzle H9, HDATA2 is data for nozzle H17, HDATA3 is data for nozzle H25, and DDATA1 is data for nozzle D5.

For normal recording without the occurrence of a slippage, nozzle D5, which is used for correction (adjustment), is not employed, and DDATA1 is null data.

When data for block number 2 of the nozzle array B is to be transmitted, similarly, DDATA0 is data for nozzle D1, HDATA0 is data for nozzle H5, HDATA1 is data for nozzle H13, HDATA2 is data for nozzle H21, HDATA3 is data for nozzle H29, and DbATA1 is unused.

For normal recording without the occurrence of a slippage, nozzle D1, which is used for correction (adjustment), is not employed, and DDATA0 is null data.

Figures 9A, 9B:
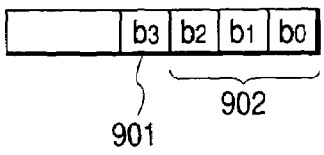
FIGS. 9A and 9B are diagrams for explaining the control of data and nozzles based on a shift direction and a shift amount.

FIG. 9A is a diagram for explaining data transfer processing, processing for selecting a nozzle to be employed, and processing for selecting a driving order.

These processes are determined in accordance with the direction in which the halted position is shifted (information for the slippage direction) and the amount of a shift. In this case, assume that, as is shown in FIG. 5, the direction from upstream to downstream in the conveying direction is denoted by Yup, and the direction from downstream to upstream in the conveying direction is denoted by Ydown; the unit for the shift amount is one pixel (one nozzle); and the data transfer processing differs depending on whether the shift amount is equivalent to an even number of pixels or an odd number of pixels.

Typical control cases will now be described.

[1. Case wherein the direction in which the halted position is shifted is Yup and the amount of slippage (the shift amount) is 1]

When the direction in which the halted position is shifted is Yup and the slippage amount (the shift amount) is equivalent to one nozzle, nozzles H0, H2, H4, . . . , H30 are selected from the nozzle array A, and the driving order block 0, block 1, block 2 and block 3 is selected for the driving of the blocks for the nozzle array A. Therefore, data are transmitted in the order block 0, block 1, block 2 and block 3, and the data that originally were to be transferred to the nozzle array B are transmitted to the nozzle array A.

On the other hand, when nozzles D3, H1, H3, . . . , H29 are selected from the nozzle array B, the driving order block 3, block 0, block 1 and block 2 is selected for driving the groups of the nozzle array B. Therefore, the data are transmitted in the order block 3, block 0, block 1 and block 2, and data that originally were to be transferred to the nozzle array A are transmitted to the nozzle array B.

In this manner, the data transfer processing, the processing for selecting nozzles to be employed and the processing for selecting the driving order are performed. And in this case, since the slippage amount is the odd number "1", not only are the nozzles to be used shifted, but also, data to be transmitted to the nozzle arrays are swapped. A signal swap used for replacing the data has a value of "1", and the nozzle driving order differs between the nozzle array A and the nozzle array B.

[2. Case wherein the direction in which the halted position is shifted is Yup and the amount of slippage (the shift amount) is 2]

When the direction in which the halted position is shifted is Yup and the slippage amount (the shift amount) is equivalent to two nozzles, nozzles D2, H0, H2, . . . , H28 are selected from the nozzle array A, and nozzles D3, H1, H3, . . . , H29 are selected from the nozzle array B. For both the nozzle array A and the nozzle array B, the driving order block 3, block 0, block 1 and block 2 is selected for driving the groups. Therefore, the data are transmitted in the order block 3, block 0, block 1 and block 2.

In this case, data to be transmitted to the nozzle arrays are not swapped (a signal swap for the replacement of data has a value of "0"). This explanation has been given for the case wherein the direction in which the halted position is shifted is Yup. Cases wherein there are slippage amounts (shift amounts) of three and four will not be explained to avoid redundancy.

[3. Case wherein the direction in which the halted position is shifted is Ydown, and the amount of a slippage (the shift amount) is 3]

When the direction in which the halted position is shifted is Ydown and the slippage amount (the shift amount) is equivalent to three nozzles, nozzles H4, H6, . . . , H30, D4 and D6 are selected from the nozzle array A, and the driving order block 2, block 3, block 1 and block 0 is selected to drive the groups of the nozzle array A. Therefore, data are transmitted in the order block 2, block 3, block 1 and block 0, and data that originally were to be transmitted to the nozzle array B are transferred to the nozzle array A.

On the other hand, nozzles H3, H5, . . . , H31 and D5 are selected from the nozzle array B, and the driving order block 1, block 2, block 3 and block 0 is selected for driving the groups of the nozzle array B. Therefore, data are transmitted in the order block 1, block 2, block 3 and block 0, and data that originally were to be transmitted to the nozzle array A are transferred to the nozzle array B.

In this case, since the slippage amount is the odd number "3", not only are the nozzles to be employed shifted, but also, data to be transmitted to the nozzle arrays are swapped. A signal swap for exchanging the data has a value of "1".

[4. Case wherein the direction in which the halted position is shifted is Ydown, and the amount of slippage (the shift amount) is 4]

When the direction in which the halted position is shifted is Ydown, and the slippage amount (the shift amount) is equivalent to four nozzles, nozzles H4, H6, . . . , H30, D4 and D6 are selected from the nozzle array A, and nozzles H5, H7, . . . , H31, D5 and D6 are selected from the nozzle array B. For both the nozzle array A and the nozzle array B, the driving order block 2, block 3, block 0 and block 1 is selected for driving the groups. Therefore, data are transmitted in the order block 2, block 3, block 0 and block 1.

In this case, data to be transferred to the nozzle arrays are not swapped (a signal swap to replace the data has a value of "0").

An explanation has been given for the case wherein the direction in which the halted position is shifted is Ydown. Cases wherein there are slippage amounts (shift amounts) of one or two will not be described to avoid redundancy.

To perform the above described control process in accordance with the shifting direction of the halted position and the amount of slippage, a table representing the control contents is stored in the storage means of the controller. Further, as is shown in FIG. 9B, a register may be provided to hold information for the shifting direction of the halted position and the amount of slippage. For example, data 902, consisting of three bits, concerning the slippage amount, or data 901, concerning the shifting direction, are stored in the register (data of "1" for Yup, or data of "0" for Ydown).

Figure 10A:
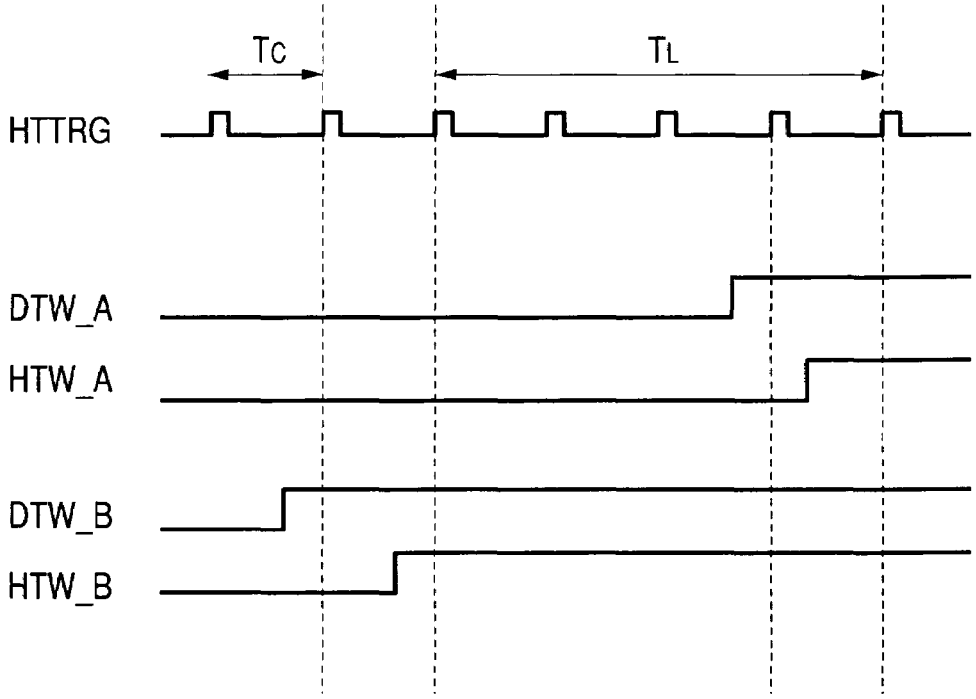
FIGS. 10A and 10B are diagrams for explaining a drive timing and a data generation timing.
Figure 10B:
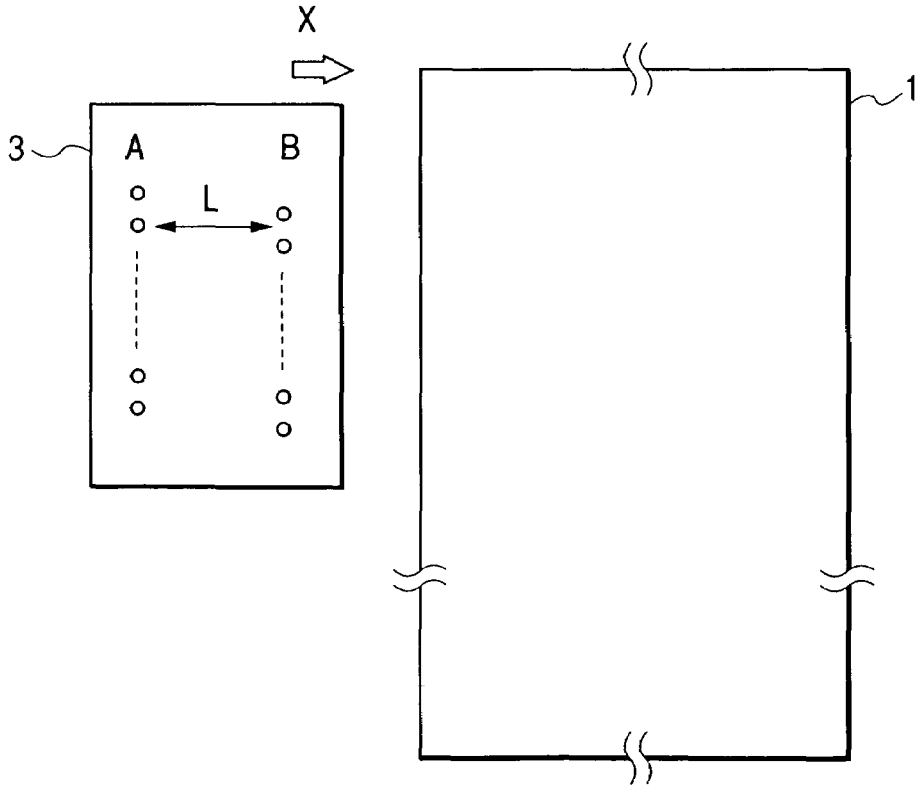

FIGS. 10A and 10B are diagrams for explaining timings for driving the recording head for the recording medium. In FIG. 10A, the recording timing is shown, i.e., a trigger signal HTTRG is shown at a cycle Tc in consonance with a resolution of 1200 dpi, for example.

DTW_A denotes a signal for transmitting a data generation notification for the nozzle array A, and is started and output in synchronization with the trigger signal HTTRG. Similarly, DTW=B denotes a signal for transmitting a data generation notification for the nozzle array B. HTW_A denotes a signal designating a period for heating the nozzle array A, and is started and output in synchronization with the trigger signal HTTRG. And HTW_B denotes a signal designating a period for heating the nozzle array B.

FIG. 10B is a diagram for explaining the scanning of the recording medium 1 performed by the recording head 3. In this case, the recording head is moved in the direction X for scanning, the distance between the nozzle array A and the nozzle array B is denoted by L, and a time interval TL between the output timing for the signal HTW_A and the output timing for the signal HTW_B corresponds to the distance L.

Thus, the signals HTW_A and HTW_B are not changed, regardless of whether the halted position is shifted; however, when data to be transmitted to the nozzle arrays are exchanged because the halted position has been shifted, the signals DTW_A and DTW_B are exchanged. This configuration is shown in FIG. 11.

Figure 11:
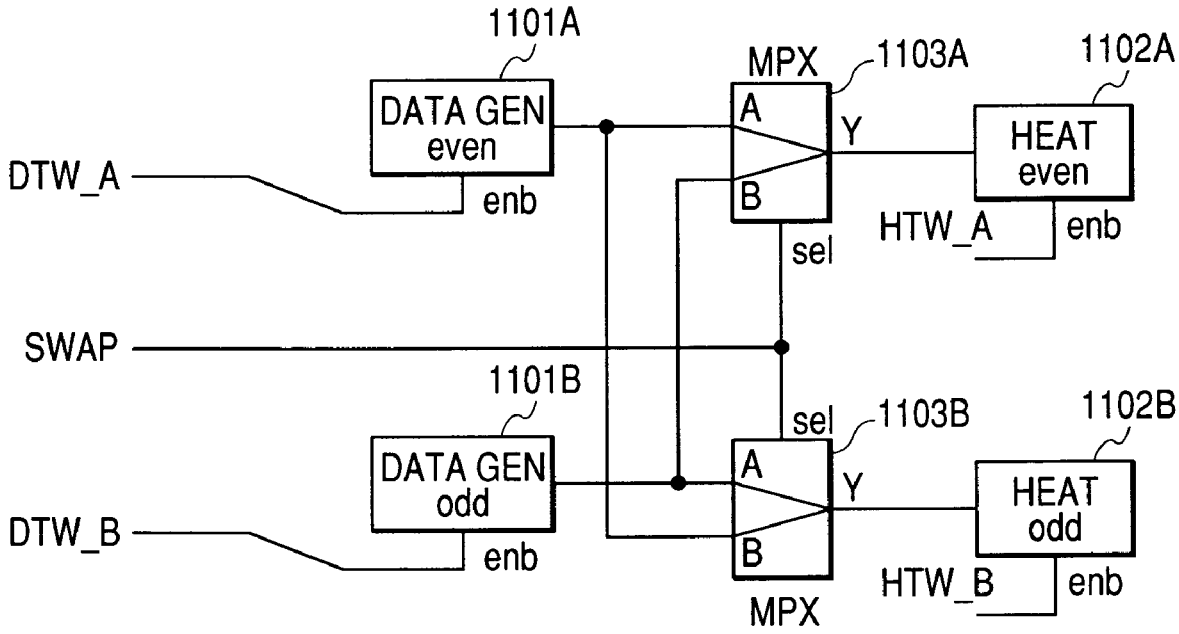
FIG. 11 is a diagram for explaining data generation and data transfer.

FIG. 11 is a diagram for explaining the state wherein the signals DTW_A and DTW_B are received, and generated data are transmitted to a heating circuit section.

A data generator 1101A generates data for the nozzle array A, and a data generator 1101B generates data for the nozzle array B. A heating unit 1102A drives the nozzles of the nozzle array A, and a heating unit 1102B drives the nozzles of the nozzle array B.

A selection circuit (MPX) 1103A receives signals DTW_A and DTW_B, selects one of these signals in accordance with a signal swap, and outputs the selected signal to the data generator 101A. A selection circuit 1103B also selects either signal DTW_A or DTW_B, and outputs the selected signal to the data generator 1101B.

A start position register and an end position register for designating the timing for the signal DTW_A are provided in the data generators 1101A and 1101B, respectively, to align the positional relationship between the signals HTW and DTW. Similarly, a start position register and an end position register for designating the timing for the signal DTW_B are provided in the data generator 1101B.

With this arrangement, the nozzles can be selected in consonance with the conveying operation (a line feed operation), and fast recording can be performed while the capability of providing high quality images is maintained.

(Other Embodiments)

The present invention is not limited to the above described embodiment. For example, an encoder may be provided for the line feed motor, and an encoder signal may be output as the line feed motor is rotated.

In the above embodiment, the encoder signals for the phases A and B are employed to count the amount of slippage of a position; however, so long as the shifting direction is obtained, either a phase A or B encoder signal may be employed.

The correlation between each slippage count value and the nozzle interval is not limited to those described in the embodiment. For example, each slippage count value may be equivalent to two nozzles.

Further, a latch time designated in the latch setup register need not always be a fixed value. When the recording apparatus has a plurality of recording modes, and when, for example, the conveying speed differs, an optimal mode, if available, may be set in accordance with each recording mode.

Furthermore, when the recording apparatus includes a recording speed preference mode (a draft mode) as a recording mode, the above described control processing may not be performed. In this case, an ON/OFF switch may be provided, and in the draft mode, the switch need only be turned off, so that the control processing explained while referring to FIG. 3 can be skipped.

According to the present invention, the number of nozzles of the recording head that are employed, when slippage occurs, for ink ejection to record an image is not limited to the above described value. In addition, the number of nozzle arrays is not limited to two.

The recording apparatus that employs the recording head for printing has been explained. However, the present invention can also be applied for an image input apparatus, such as a scanner. For example, the present invention can be applied for an apparatus wherein a scanner unit, which may be replaced by a recording head, can be mounted on a carriage, and wherein the scanner unit can read a document conveyed by conveying means. When, for example, a reading sensor (a line sensor wherein CCDs are arranged in the same direction as are the nozzle arrays) performs the reading of a document, a circuit block for designating the location of a pixel, for which a sensor is provided to input an image, need only be provided for a gate array. Then, when slippage occurs, an image can be input in consonance with the slippage.

This application claims priority from Japanese Patent Application No. 2003-311446 filed Sep. 3, 2003, which is hereby incorporated by reference herein.

What is claimed is:

1. A recording apparatus for recording on a recording medium using a recording head provided with a plurality of orifices, comprising:

conveying means for conveying the recording medium;

a motor for driving said conveying means;

signal generation means for outputting a signal in accordance with an operation of said conveying means;

interruption output means for receiving the signal and outputting an interruption signal when said conveying means realizes arrival at a predetermined position;

counting means for counting, after the interruption signal has been output, an operating amount of said conveying means by using the signal output by said signal generation means;

nozzle selection means for selecting a nozzle to be used for recording, from among the plurality of nozzles, in accordance with a count value of said counting means; and recording means for performing recording using the nozzle selected by said nozzle selection means.

2. A recording apparatus according to claim 1, wherein said signal generation means is an encoder.

3. A recording apparatus according to claim 1, wherein, during a predetermined period following the output of the interruption signal, said counting means counts an operating amount of said motor.

4. A recording apparatus for recording on a recording medium using a recording head provided with a plurality of orifices, comprising:

conveying means for conveying the recording medium;

a motor for driving said conveying means;

signal generation means for outputting a signal in accordance with an operation of said motor;

interruption output means for receiving the signal and outputting an interruption signal when said motor realizes arrival at a predetermined position;

counting means for counting, after the interruption signal has been output, an operating amount of said motor by using the signal output by said signal generation means;

nozzle selection means for selecting a nozzle to be used for recording, from among the plurality of nozzles, in accordance with a count value of said counting means; and recording means for performing recording using the nozzle selected by said nozzle selection means.

5. A recording apparatus for recording on a recording medium using a recording head provided with a plurality of nozzle arrays, comprising:

conveying means for conveying the recording medium;

designation means for designating a predetermined halted location for said conveying means;

acquisition means for obtaining an amount of slippage between the predetermined halted position, designated by said designation means, and an actual halted position to which the recording medium is actually conveyed by said conveying means;

nozzle selection means for selecting, for each of the nozzle arrays, a nozzle to be used for recording;

data generation means for generating recording data for each of the nozzle arrays;

allocation means for allocating, to the nozzle selected by said nozzle selection means, the recording data generated by said data generation means; and control means for controlling said nozzle selection means, and said allocation means based on the amount of slippage obtained by said acquisition means.

6. A recording apparatus according to claim 5, further comprising:

drive means for driving each of groups into which a plurality of nozzles of the nozzle arrays are divided; and drive control means for changing a driving order for said drive means on the basis of the amount of slippage.

7. A recording apparatus according to claim 6, further comprising:

an output circuit for transferring data, for each of the groups, to the recording head in the driving order, wherein, through the data transfer, codes representing recording data and a group number are transmitted.

8. A recording apparatus according to claim 6, wherein information on a direction regarding a shift from the predetermined halted position, designated by said designation means, to the actual halted position of the recording medium conveyed by said conveying means, is obtained, and wherein said drive control means changes the driving order based on the amount of slippage and the shift direction.

9. A recording apparatus according to claim 5, wherein said data generation means includes a register for designating a recording start position and a recording end position in a scanning direction of the recording head, and wherein said control means changes a value of said register based on the amount of slippage.

10. A recording apparatus for recording on a recording medium using a recording head provided with a plurality of nozzle arrays, comprising:

conveying means for conveying the recording medium;

designation means for designating a predetermined halted position for said conveying means;

acquisition means for obtaining a differential amount between the predetermined halted position, designated by said designation means, and a position at which the recording medium, conveyed by said conveying means, is actually halted;

nozzle selection means for selecting, for each of the nozzle arrays, a nozzle used for recording;

data generation means for generating recording data for each of the nozzle arrays;

driving means for driving each of the nozzle arrays;

transfer selection means for changing, for said driving means, a destination for the transfer of the recording data generated by said data generation means; and control means for controlling said nozzle selection means and said transfer selection means based on the differential amount obtained by said acquisition means.

* * * * *